US009970244B1

(12) United States Patent
Murphree

(10) Patent No.: US 9,970,244 B1
(45) Date of Patent: May 15, 2018

(54) ACCELERATED ROD AND SINKER BAR BREAK OUT DEVICE

(71) Applicant: Guy Mac Murphree, Midland, TX (US)

(72) Inventor: Guy Mac Murphree, Midland, TX (US)

( * ) Notice: Subject to any disclaimer, the term of this patent is extended or adjusted under 35 U.S.C. 154(b) by 0 days. days.

(21) Appl. No.: 15/809,283

(22) Filed: Nov. 10, 2017

Related U.S. Application Data

(60) Provisional application No. 62/448,915, filed on Jan. 20, 2017.

(51) Int. Cl.
*E21B 19/16* (2006.01)

(52) U.S. Cl.
CPC ..... *E21B 19/163* (2013.01); *E21B 19/165* (2013.01); *E21B 19/167* (2013.01)

(58) Field of Classification Search
CPC .... E21B 19/161; E21B 19/163; E21B 19/165; E21B 19/167
See application file for complete search history.

(56) References Cited

U.S. PATENT DOCUMENTS 1,634,602 A * 7/1927 Wilson ..... E21B 19/167 81/57.28
2,556,536 A * 6/1951 Harris ..... E21B 19/167 81/55
3,141,362 A * 7/1964 Tamny ..... E21B 19/167 81/128
3,500,708 A * 3/1970 Wilson ..... E21B 19/163 81/57.34
4,727,781 A * 3/1988 Yuehui ..... E21B 19/163 81/57.19
5,060,542 A * 10/1991 Hauk ..... E21B 19/163 81/57.16
5,386,746 A * 2/1995 Hauk ..... E21B 19/163 81/57.16
5,433,128 A * 7/1995 Wacker ..... B25B 13/488 81/57.34
6,931,965 B1 * 8/2005 Fanguy ..... B25B 13/488 81/57.34
7,000,503 B2 * 2/2006 Dagenais ..... E21B 19/164 81/432
7,013,759 B1 * 3/2006 Childress, II ..... E21B 19/163 74/422
9,328,571 B2 * 5/2016 Taggart ..... E21B 19/163
(Continued)

*Primary Examiner* — Blake E Michener
(74) *Attorney, Agent, or Firm* — Buskop Law Group, P.C.; Wendy Buskop

(57) ABSTRACT

An accelerated rod and sinker bar break out device having a base, a pivoting hydraulic cylinder with a stationary wrench and a pivoting wrench. A hydraulic control assembly controls hydraulic cylinder operation and has a manifold with input port for receiving hydraulic fluid from a reservoir and an output port for transferring hydraulic fluid to the reservoir. The manifold can have a first bidirectional control port to flow hydraulic fluid to and from a first pivoting hydraulic cylinder port and a second bidirectional control port to flow hydraulic fluid to and from a second pivoting hydraulic cylinder port. The manifold has a lever, which movably changes hydraulic fluid flow rates to the pivoting hydraulic cylinder and interfaces with a primary pressure adjustment valve.

19 Claims, 10 Drawing Sheets

(56) References Cited

U.S. PATENT DOCUMENTS

| | | | | |
|---|---|---|---|---|
| 2001/0000550 | A1* | 5/2001 | Newman | B25B 21/002 29/714 |
| 2002/0178871 | A1* | 12/2002 | Hauk | E21B 19/164 81/57.16 |
| 2003/0056989 | A1* | 3/2003 | Smith | E21B 19/167 175/57 |
| 2003/0140736 | A1* | 7/2003 | Buck | E21B 19/165 81/57.35 |
| 2004/0216890 | A1* | 11/2004 | Hemphill | E21B 19/165 166/380 |
| 2005/0096846 | A1* | 5/2005 | Koithan | E21B 19/165 702/6 |
| 2008/0185154 | A1* | 8/2008 | Holladay | E21B 19/167 166/377 |
| 2009/0038789 | A1* | 2/2009 | Carstensen | E21B 19/164 166/77.51 |
| 2014/0262329 | A1* | 9/2014 | Fournier | E21B 19/161 166/377 |
| 2014/0299313 | A1* | 10/2014 | Messmer | E21B 19/161 166/77.51 |
| 2016/0369579 | A1* | 12/2016 | Li | E21B 19/163 |

* cited by examiner

ACCELERATED ROD AND SINKER BAR BREAK OUT DEVICE

CROSS REFERENCE TO RELATED APPLICATIONS

The present application claims priority to and the benefit of U.S. Provisional Patent Application Ser. No. 62/448,915 filed on Jan. 20, 2017, entitled "ACCELERATED ROD AND SINKER BAR BREAK OUT DEVICE". This reference is hereby incorporated in its entirety.

FIELD

The present embodiments generally relate to a device for breaking out rods and sinker bars emerging from a wellbore.

BACKGROUND

A need exists for a fast, easy to use device that can be used at ground level or elevated to break out rod or sinker bars, preventing injury or death to oilfield hands and workers.

The present embodiments meet these needs.

BRIEF DESCRIPTION OF THE DRAWINGS

The detailed description will be better understood in conjunction with the accompanying drawings as follows.

Figure 1:
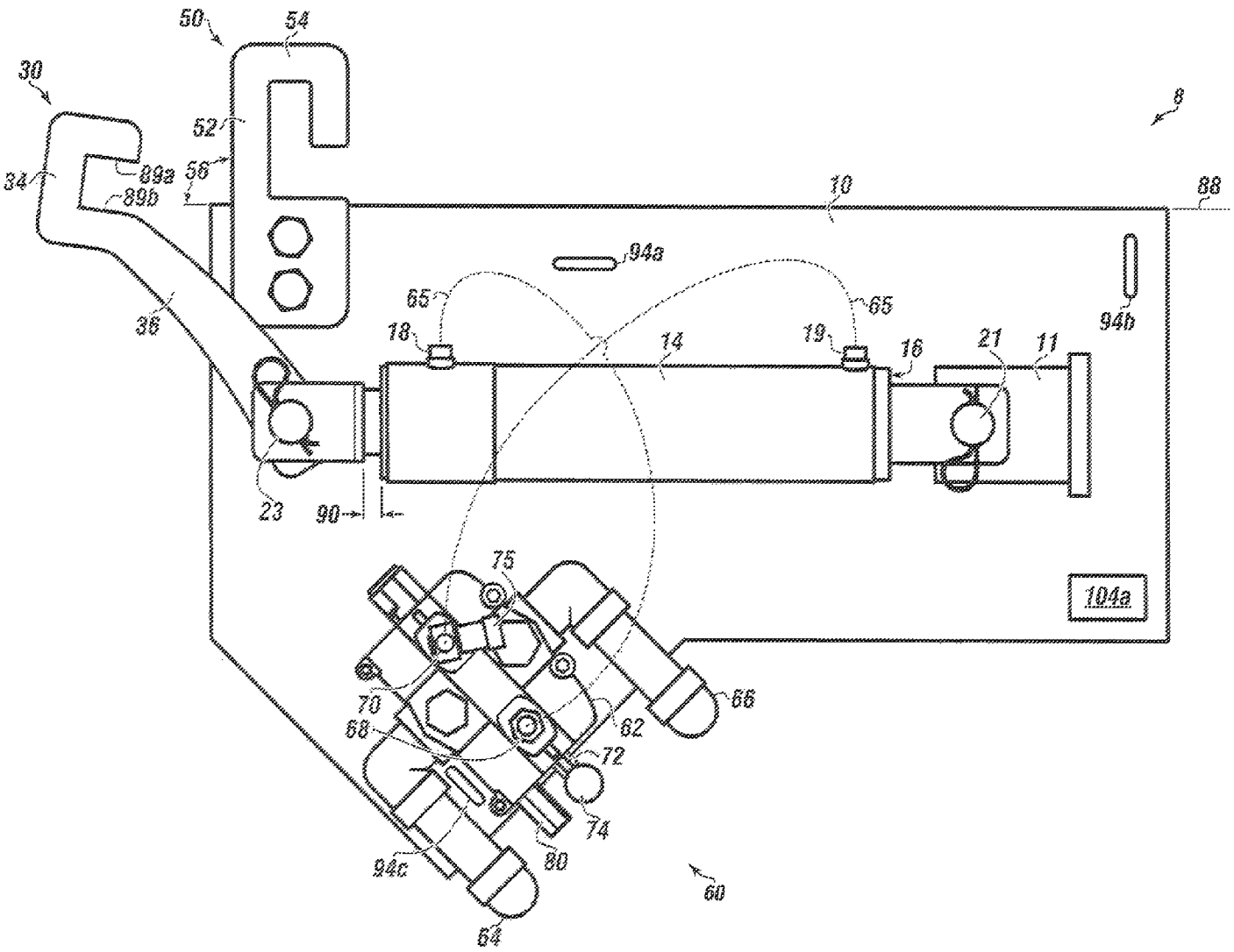
FIG. 1 depicts a top view of the device according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a device for breaking out rods and sinker bars emerging from a wellbore.

The accelerated rod and sinker bar break out device can be used on rods and sinker bars extending from a wellbore.

The accelerated rod and sinker bar break out device can have a base with a base support.

The base can be a flat metal plate, a lidless metal box, a specially shaped plate.

A plurality of flexible hanging devices can be attached to the base. In embodiments, the flexible handing devices can be chain.

The flexible hanging devices can be removably connected to the base enabling hoisting of the accelerated rod and sinker bar break out device.

A pivoting hydraulic cylinder can be connected to the base support on a first end.

The pivoting hydraulic cylinder can have a cylinder rod, a first pivoting hydraulic cylinder port, and a second pivoting hydraulic cylinder port. The ports can bidirectionally receive or expel hydraulic fluid.

In embodiments, a first pin can connect the pivoting hydraulic cylinder to the base support, maintaining the pivoting hydraulic cylinder above the base.

A pivoting wrench can connect to a cylinder rod of the pivoting hydraulic cylinder or a first end. The pivoting wrench can have wrench flats for grabbing at wrench flats on a rod or sinker bar.

A second pin can connect the pivoting wrench to the pivoting hydraulic cylinder.

The wrench flats of the pivoting wrench can be formed at a 45 degree angle to the second pin.

In embodiments, the device can have a stationary wrench connected to the base, which can have a hook shape.

The stationary wrench can have an arm connected to a cylinder rod clevis. The cylinder rod clevis can engage the rod or sinker bar wrench flats.

The arm of the stationary wrench can extend at an angle, such as 90 degrees, to a plane of the base. The head of the stationary wrench can be configured for engaging a wrench flat formed on the rod or sinker bar extending from a wellbore.

In embodiments, the accelerated rod and sinker bar break out device can include a hydraulic control assembly mounted to the base.

In embodiments, the accelerated rod and sinker bar break out device is portable, movable, and relocatable. In embodiments, the accelerated rod and sinker bar break out device can weigh from 50 pounds to 150 pounds.

In embodiments, the hydraulic control assembly can have a manifold. The manifold can have a first pivoting hydraulic cylinder inlet port for receiving hydraulic fluid from a reservoir and a second pivoting hydraulic cylinder output port for transferring hydraulic fluid to the reservoir.

The manifold can have a first bidirectional control port to bidirectionally flow hydraulic fluid to and from a first pivoting hydraulic cylinder port and a second bidirectional control port to bidirectionally flow hydraulic fluid to and from the second pivoting hydraulic cylinder port.

The accelerated rod and sinker bar break out device can have a lever engaging a manifold rod, which can be mounted in the manifold, for changing hydraulic fluid flow rates to and from the pivoting hydraulic cylinder.

The device can have a primary pressure control valve to adjust hydraulic fluid pressure to the pivoting hydraulic cylinder.

The accelerated rod and sinker bar break out device can be elevated enabling rod break out at an elevation from a top of a wellhead to 35 feet above the wellhead.

The pivoting wrench and the pivoting hydraulic cylinder can simultaneously pivot to engage a wrench flat on rods and sinker bars to break out the rods and sinker bars.

The pivoting wrench can be configured to operate right side up and upside down for optimizing pivoting wrench flat fit.

In embodiments, the accelerated rod and sinker bar break out device can have an active radio frequency identification chip, which can be secured to the base for tracking a GPS location of each accelerated rod and sinker bar break out device when deployed.

The radio frequency identification chip can communicate via a network to a client device, which can have a client device display and a client device processor.

The client device data storage can have computer instructions for instructing the client device processor to position the GPS location of the accelerated rod and sinker bar break out device geographically on a map.

In embodiments, the accelerated rod and sinker bar break out device can have a microprocessor, which can be connected to a plurality of pressure sensors for automatically monitoring and comparing detected pressures to preset limits stored in a microprocessor data storage.

The microprocessor data storage can contains computer instructions for instructing the microprocessor to provide an alarm to a client device processor via the network when the pressure falls below or exceeds the preset limits.

In embodiments, a support beam can be mounted parallel to the pivoting hydraulic cylinder to prevent collapse of the base.

In embodiments, the hydraulic pressure of the hydraulic fluid in the manifold can be from 1000 psi to 3000 psi.

In embodiments, the pivoting wrench and the stationary wrench can each have a thickness from ½ inch to 1 inch.

In embodiments, the pivoting wrench and the stationary wrench can each be made from a hardened high tensile strength solid steel that has been hardened to a Rockwell 55 hardness.

In embodiments, the pivoting wrench and the stationary wrench can each have a length from 4 inches to 12 inches.

In embodiments, the pivoting wrench can have a head with a length different than the head of the stationary wrench.

In embodiments, the pivoting wrench arm can have an arm length different than the stationary wrench arm length.

In embodiments, the stationary wrench can have a hook shape to hold the accelerated rod and sinker bar break out device stable as the pivoting wrench head is attached to the wrench flats of rods and sinker bars being broke out.

The term "break out" as used herein refers to loosen a tight connection between the rods that are screwed together, so that the connection can be unscrewed by hand. Rods are not being "broken" during break out, a threaded connection is simply loosened.

The term "client device" as used herein can refer to any client device known in the industry, such as a cellular phone, a laptop, a desktop computer, a tablet computer, a cloud based computer processor, or any device with bidirectional communication capabilities.

The term "data storage" refers to a non-transitory computer readable medium, such as a hard disk drive, solid state drive, flash drive, tape drive, and the like. The term "non-transitory computer readable medium" excludes any transitory signals but includes any non-transitory data storage circuitry, e.g., buffers, cache, and queues, within transceivers of transitory signals.

The term "GPS" as used herein refers to a global positioning system.

The term "network" as used herein can refer any network known in the industry, such as the internet, a local area network, a wide area network, a satellite network, a cellular network or another type of wireless network or combinations of networks.

The term "processor" as used herein can refer to any computer or processing device known in the industry, such as a programmable logic circuit.

Turning now to the Figures, FIG. 1 depicts an accelerated rod and sinker bar break out device according to one or more embodiments.

The accelerated rod and sinker bar break out device 8 can have a base 10 with a base support 11.

In embodiments, the base support can extend from 2 inches to 10 inches from the base.

The base can have a plane 88 on one side. The base can be suspended from a plurality of pad eyes 94*a*-94*c* using a plurality of flexible hanging devices (not visible in this Fig.). The plurality of hanging devices can be connected to the base enabling hoisting of the accelerated rod and sinker bar break out device.

The accelerated rod and sinker bar break out device can include a pivoting hydraulic cylinder 14, which can be connected to the base support 11 on a first end 16.

The pivoting hydraulic cylinder can have a dimension of 3 and ½×12 inch stroke and be usable herein. The total length of the pivoting hydraulic cylinder with retracted cylinder rod between a first pin and a second pin can be 22 and ¼ inch. The cylinder rod of the cylinder can extend 12 more inches, providing a total length extended of 34 and ¼ inches.

The pivoting hydraulic cylinder can have a cylinder rod (shown in FIG. 2), a first pivoting hydraulic cylinder port 18, and a second pivoting hydraulic cylinder port 19.

A first pin 21 can connect the first end 16 of the pivoting hydraulic cylinder 14 to the base support 11.

A pivoting wrench 30 with an angled wrench head 34 and a pivoting wrench arm 36 can connect to the cylinder rod.

The angled wrench head can have wrench flats 89*a*-89*b* for engaging wrench flats on a rod or sinker bar.

A second pin 23 can connect the pivoting wrench 30 to the pivoting hydraulic cylinder 14.

The first and second pins can be solid cylinders of metal with two perforations, wherein each perforation can be used for holding a cotter pin at each end.

A stationary wrench 50 can connect to the base 10, such as with a plurality of bolts.

The stationary wrench 50 can be a one piece unit with an integral arm 52 connected to a head 54.

The arm 52 can extend at an angle 56, such as 90 degree angle, to the plane 88 of the base 10.

The head 54 of the stationary wrench can also be configured for engaging wrench flats formed on rods or sinker bars extending from the wellbore.

The cylinder rod is shown extending at a first distance 90 from the pivoting hydraulic cylinder 14. In embodiments, the first distance 90 can be zero when the cylinder rod is in a fully retracted position.

The accelerated rod and sinker bar break out device can include a hydraulic control assembly 60, which can be mounted to the base 10.

The hydraulic control assembly 60 can have a manifold 62. The manifold 62 can have an input port 64 for receiving hydraulic fluid 65 from a reservoir and an output port 66 for transferring the hydraulic fluid 65 to the reservoir.

The manifold 62 can have a first bidirectional control port 68 to flow the hydraulic fluid 65 to and from the first pivoting hydraulic cylinder port 18.

The manifold 62 can have a second bidirectional control port 70 to flow the hydraulic fluid 65 to and from the second pivoting hydraulic cylinder port 19.

The hydraulic control assembly 60 can have a lever 74, which can be used for engaging a manifold rod 72 in the manifold 62 for movably changing hydraulic fluid flow rates to and from the pivoting hydraulic cylinder 14.

The hydraulic control assembly 60 can have a primary pressure control valve 80 to adjust hydraulic fluid pressure to and from the pivoting hydraulic cylinder 14. Usable pressure adjustment valves are available from Parker Industries, of Texas.

In embodiments, a cylinder speed valve 75 can be used for controlling the flow of the hydraulic fluid through the pivoting hydraulic cylinder 14 in order to control the speed at which the cylinder rod moves back and forth in the pivoting hydraulic cylinder.

In embodiments, an active radio frequency identification chip 104*a* can be secured to the base 10 for tracking a GPS location of each accelerated rod and sinker bar break out device when deployed.

Figure 2:
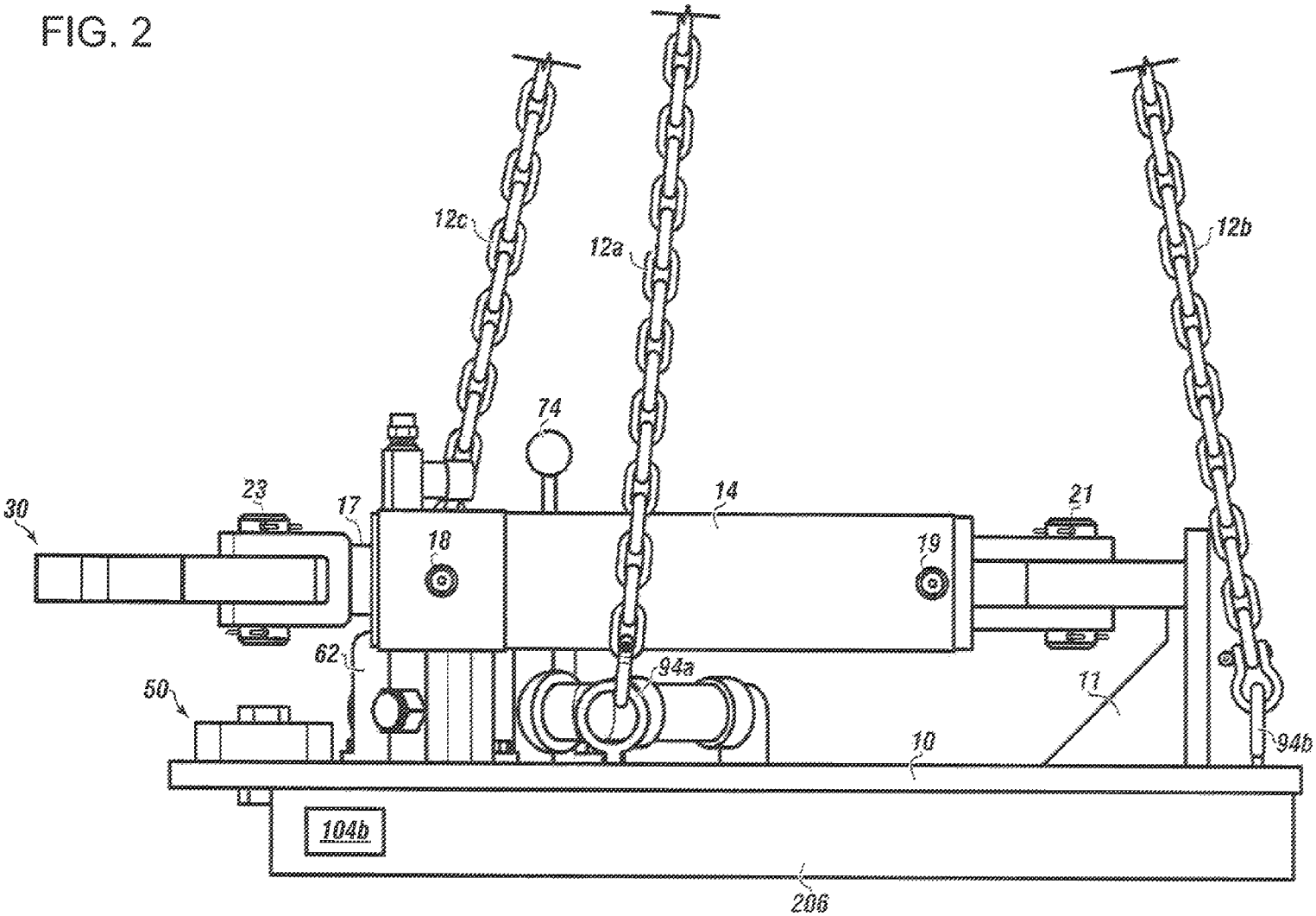
FIG. 2 depicts a side view of the device according to one or more embodiments.

FIG. 2 depicts a side view of the accelerated rod and sinker bar break out device according to one or more embodiments.

The plurality of flexible hanging devices 12*a*-12*c* can be connected to the base 10 enabling hoisting of the accelerated rod and sinker bar break out device.

In this embodiment, the flexible hanging devices are shown as chain. The chain can be 4 foot long ¼ inch steel chain.

The pivoting wrench 30 can be connected to the cylinder rod 17 of the pivoting hydraulic cylinder 14 using the second pin 23.

The stationary wrench 50 can be connected to the base 10. The stationary wrench 50 is shown below the pivoting wrench 30 at a distance, such as 2 inches and 9 inches, depending on the height of the base support 11.

The plurality of pad eyes 94*a*-94*b* can be used to support each of the plurality of flexible hanging devices 12*a*-12*c*.

The pivoting hydraulic cylinder 14 can have the cylinder rod 17 extending from one end. The pivoting hydraulic cylinder can engage the base support 11 on a side opposite the cylinder rod 17 using the first pin 21.

The pivoting wrench 30 can engage the cylinder rod 17 with the second pin 23.

The pivoting hydraulic cylinder 14 is shown with the first pivoting hydraulic cylinder port 18 and the second pivoting hydraulic cylinder port 19.

The lever 74 can engage the manifold rod of the manifold 62.

A support beam 206 can be mounted parallel to the pivoting hydraulic cylinder 14 to prevent collapse of the base.

An additional radio frequency identification chip 104*b* is shown and can be disposed on the support beam.

Figure 3:
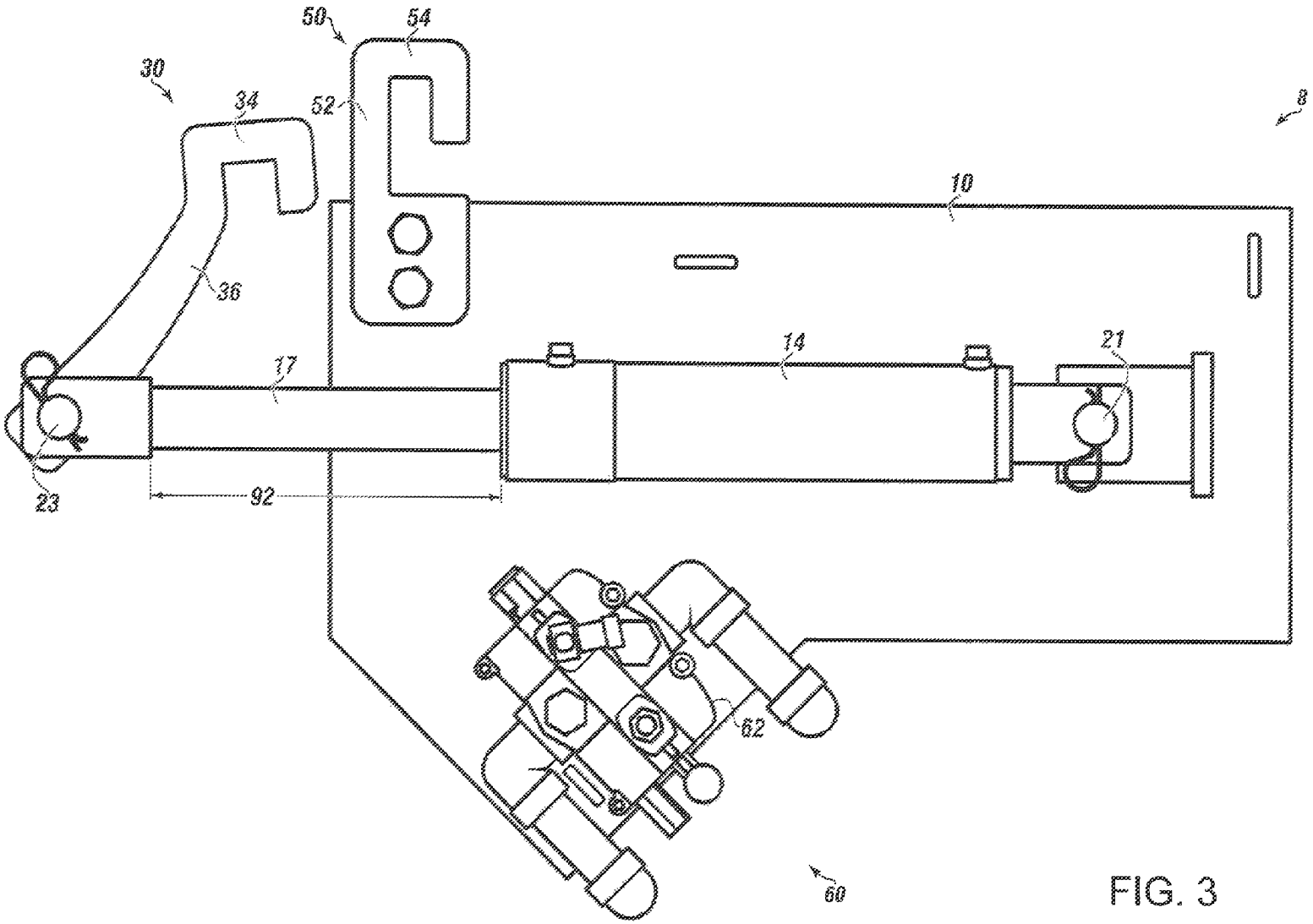
FIG. 3 depicts a top view of the device with a cylinder rod of a pivoting hydraulic cylinder extended according to one or more embodiments.

FIG. 3 depicts a top view of the accelerated rod and sinker bar break out device with a cylinder rod of a pivoting hydraulic cylinder extended according to one or more embodiments.

The accelerated rod and sinker bar break out device 8 is shown with the cylinder rod 17 extended from the pivoting hydraulic cylinder 14.

The accelerated rod and sinker bar break out device 8 is shown with the base 10 supporting the pivoting hydraulic cylinder 14 extending the cylinder rod 17 at a second distance 92.

The pivoting wrench 30 is shown connected to the cylinder rod 17 by the second pin 23. The pivoting wrench 30 is shown with the angled wrench head 34 connected to the pivoting wrench arm 36.

The stationary wrench 50 is depicted with the head 54 connected to arm 52.

The pivoting hydraulic cylinder 14 can be connected to the base support with the first pin 21.

The hydraulic control assembly 60 with the manifold 62 is shown.

Figure 4:
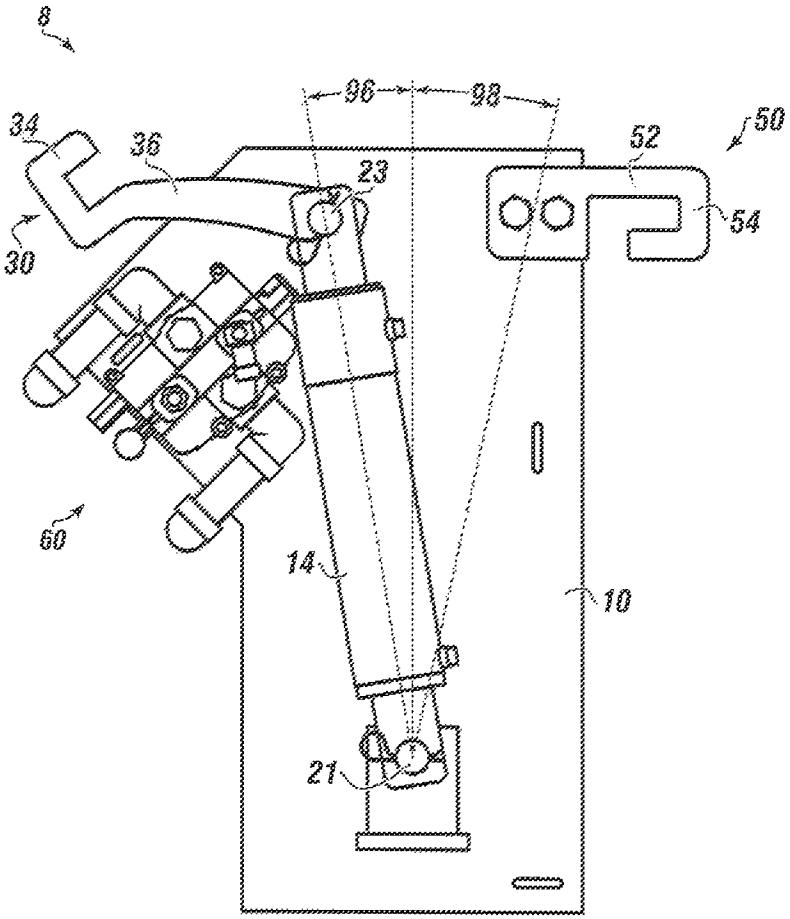
FIG. 4 shows the pivoting movement of the pivoting hydraulic cylinder according to one or more embodiments.

FIG. 4 shows the pivoting movement of the pivoting hydraulic cylinder according to one or more embodiments.

The pivoting hydraulic cylinder 14 can be mounted to the base 10 using the base support with the first pin 21.

The pivoting hydraulic cylinder 14 can be pivoted through a first angle 96 or a second angle 98 to allow an operator to easily move the pivoting wrench 30 into position. The first angle 96 can be from 0 degrees to 10 degrees and the second angle 98 can be from 0 degrees to 25 degrees.

The hydraulic control assembly 60 can be mounted to the base 10, which can have a shape that is not rectangular and is angular. Many base shapes can be used, such as triangles and octagons. The pivoting wrench 30 with the angled wrench head 34 and the pivoting wrench arm 36 can be connected to the cylinder rod via the second pin 23. The stationary wrench 50 with the head 54 and the arm 52 are also shown.

Figure 5:
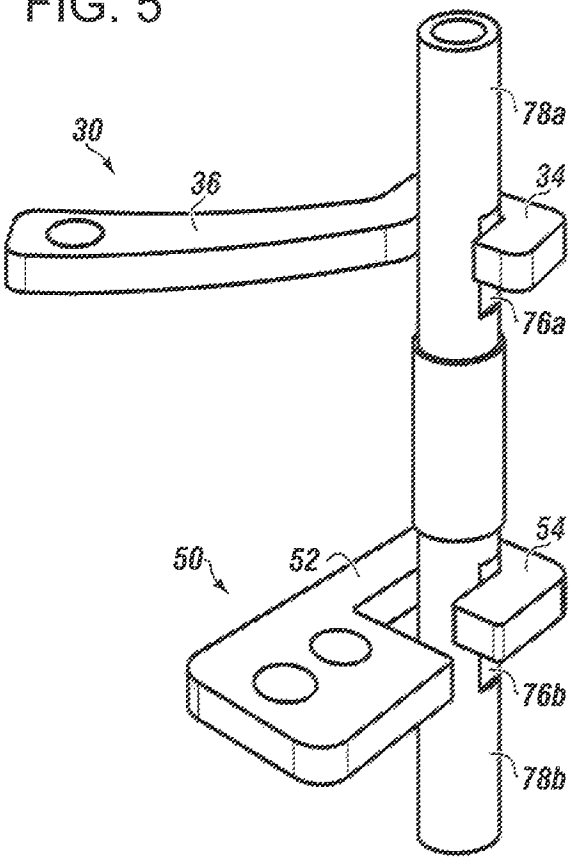
FIG. 5 shows a detail of a pivoting wrench according to one or more embodiments.

FIG. 5 shows a detail of a pivoting wrench according to one or more embodiments.

The pivoting wrench 30 with the pivoting wrench arm 36 and the angled wrench head 34. The angled wrench head can be secured to a wrench flat 76*a* of a rod 78*a*.

The stationary wrench 50 with the arm 52 and the head 54, wherein the head 54 can be secured to a different wrench flat 76*b* for a different rod 78*b* for break out of the rods.

Figure 6:
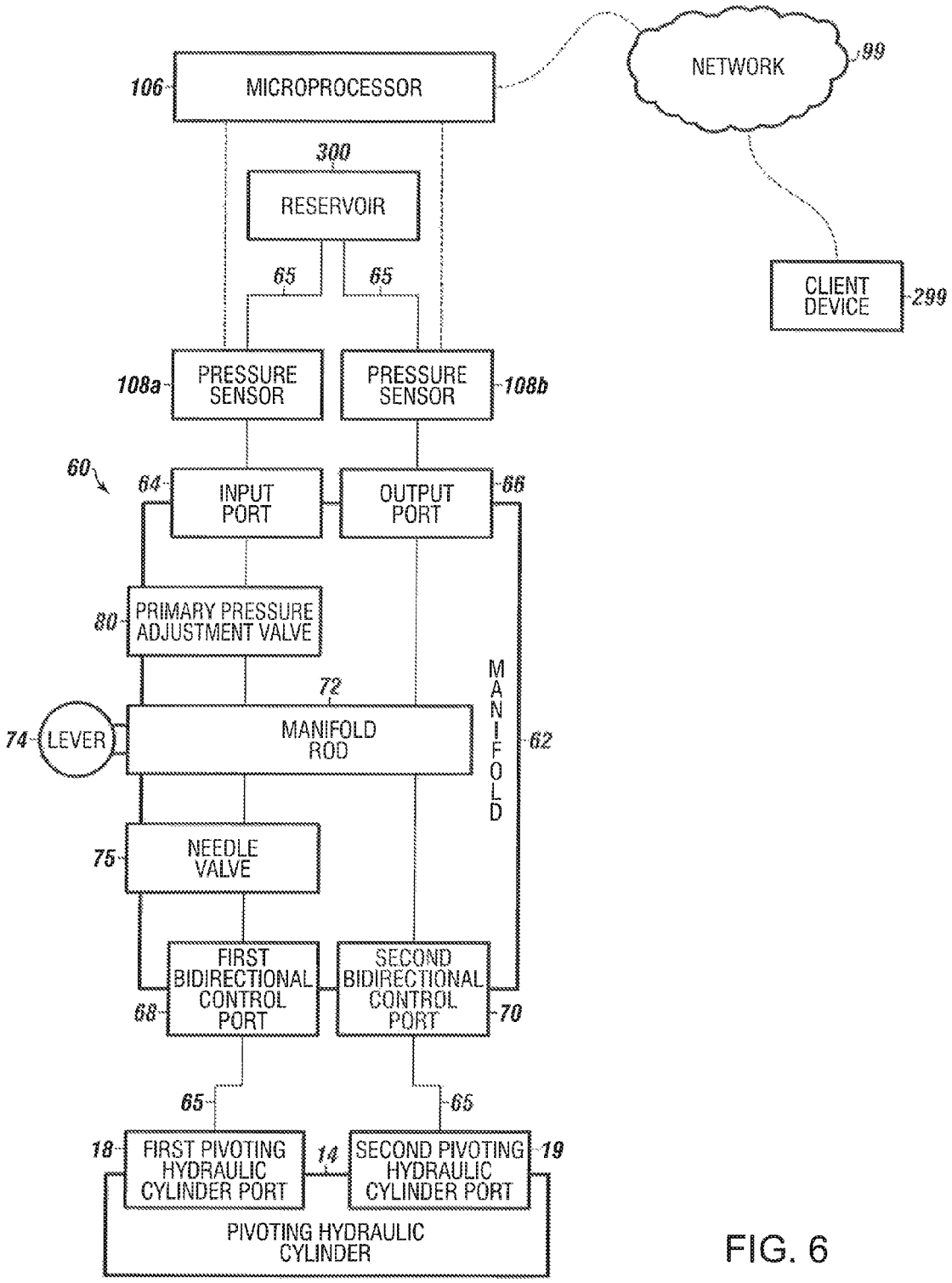
FIG. 6 is a diagram of the flow of hydraulic fluid through the device according to one or more embodiments.

FIG. 6 is a diagram of the flow of hydraulic fluid through the accelerated rod and sinker bar break out device according to one or more embodiments.

In this embodiment, a reservoir 300 can supply the hydraulic fluid 65 to the input port 64 of the manifold 62 past a pressure sensor 108*a*.

The pressure of the hydraulic fluid in the manifold 62 can be adjusted with the primary pressure control valve 80.

The manifold rod 72 in the manifold 62 of the hydraulic control assembly can be actuated by the lever 74. The manifold rod 72 controls the hydraulic fluid 65 through the first bidirectional control port 68 to the first pivoting hydraulic cylinder port 18 to power the cylinder rod in the pivoting hydraulic cylinder 14.

The hydraulic fluid 65 can flow into the second bidirectional control port 70 to and from the second pivoting hydraulic cylinder port 19.

A cylinder speed valve 75 can control the speed of the cylinder rod.

A pressure sensor 108*b* can monitor pressure of the hydraulic fluid 65 as it is returned to the reservoir 300 from the output port 66.

A microprocessor 106 can be in communication with the pressure sensors 108*a*-108*b* and the primary pressure control valve 80 to communicate information to a network 99 and at least one client device 299 connected to the network to control operations.

Figure 7:
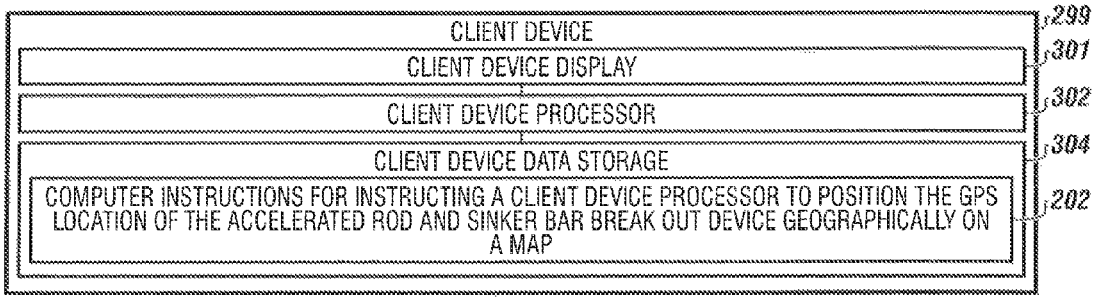
FIG. 7 is a detail of a client device according to one or more embodiments.

FIG. 7 is a detail of a client device according to one or more embodiments.

At least one client device 299, which can have a client device display 301 connected to a client device processor 302 and a client device data storage 304 can be in communication with the network.

The client device data storage 304 can contain computer instructions 202 for instructing the client device processor to position the GPS location of the accelerated rod and sinker bar break out device geographically on a map.

In embodiments, the computer instructions can use a signal from the radio frequency identification chip. In embodiments the radio frequency identification chip can be in communication with the network, which can in turn communication to the at least one client device 299.

Figure 8:
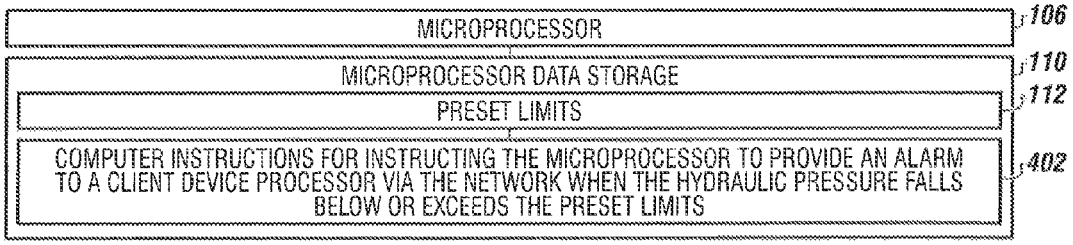
FIG. 8 is a detail of a microprocessor according to one or more embodiments.

FIG. 8 is a detail of a microprocessor according to one or more embodiments.

The microprocessor 106 can be connected to at least one pressure sensor (as shown in FIG. 6), or a plurality of pressure sensors, for automatically detecting pressure of the hydraulic fluid in the accelerated rod and sinker bar break out device.

The microprocessor can communicate with a microprocessor data storage 110.

The microprocessor data storage 110 can have preset limits 112, such as preset pressure limits for the hydraulic fluid in the pivoting hydraulic cylinder.

The microprocessor data storage 110 can contain computer instructions 402 for instructing the microprocessor to provide an alarm to a client device processor via the network when the hydraulic fluid pressure falls below or exceeds the preset limits.

FIGS. 9A-9E depict another embodiment of the invention.

Figure 9A:
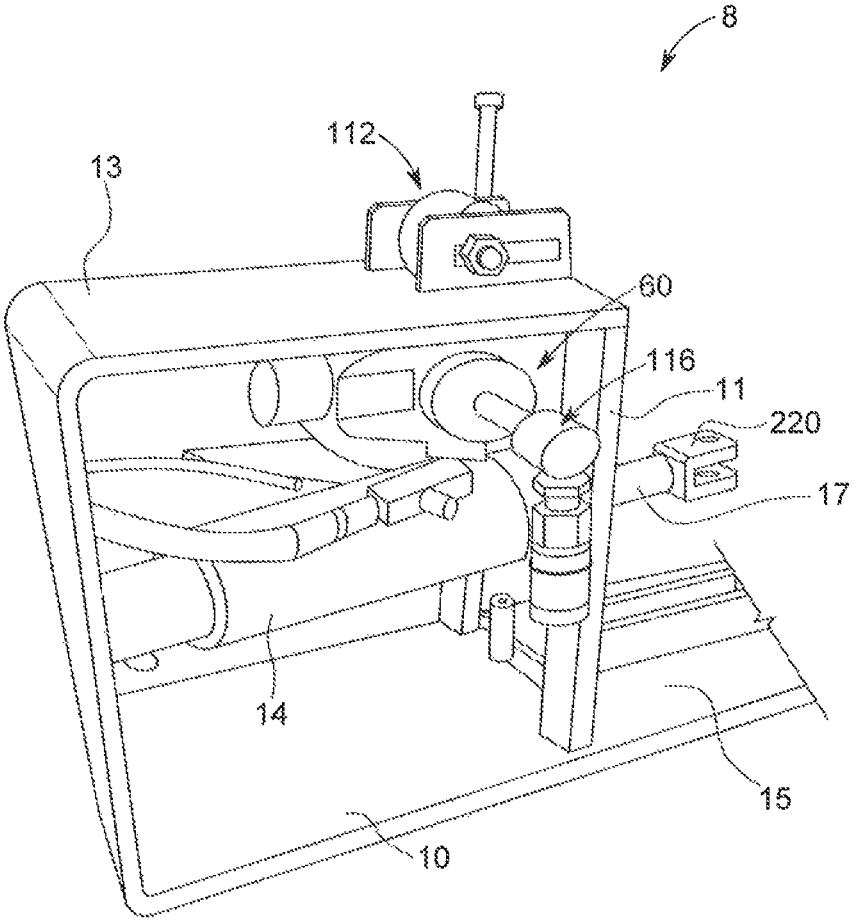
FIG. 9A-9E depict another embodiment of the device according to one or more embodiments.

FIG. 9A depicts an accelerated rod and sinker bar break out device 8 for rods and sinker bars extending from a wellbore.

The accelerated rod and sinker bar break out device 8 has a base 10 with a base support 11 rising from the base at a right angle and an extended side 15 extending away from the base in the same plane as the base.

In embodiments, an integral one piece frame 13 can be connected to the base 10 having an L shaped configuration. The integral one piece frame 13 can be made of steel plate capable of sustaining pressures of 200 psi without deforming.

A flexible hanger and leveling device 112 is removably connected to the integral one piece frame configured for supporting the accelerated rod and sinker bar break out device while hoisting.

The flexible hanger and leveling device 112 can be mounted to the portion of the integral one piece frame 13 opposite the base 10.

A pivoting hydraulic cylinder 14 can be mounted within the integral one piece frame 13 and connects through the base support 11.

The pivoting hydraulic cylinder 14 can have a cylinder rod 17. A cylinder rod clevis 220 can be mounted to the cylinder rod 17.

In embodiments, a hydraulic control assembly 60 and the outlet port 116 are shown.

Figure 9B:
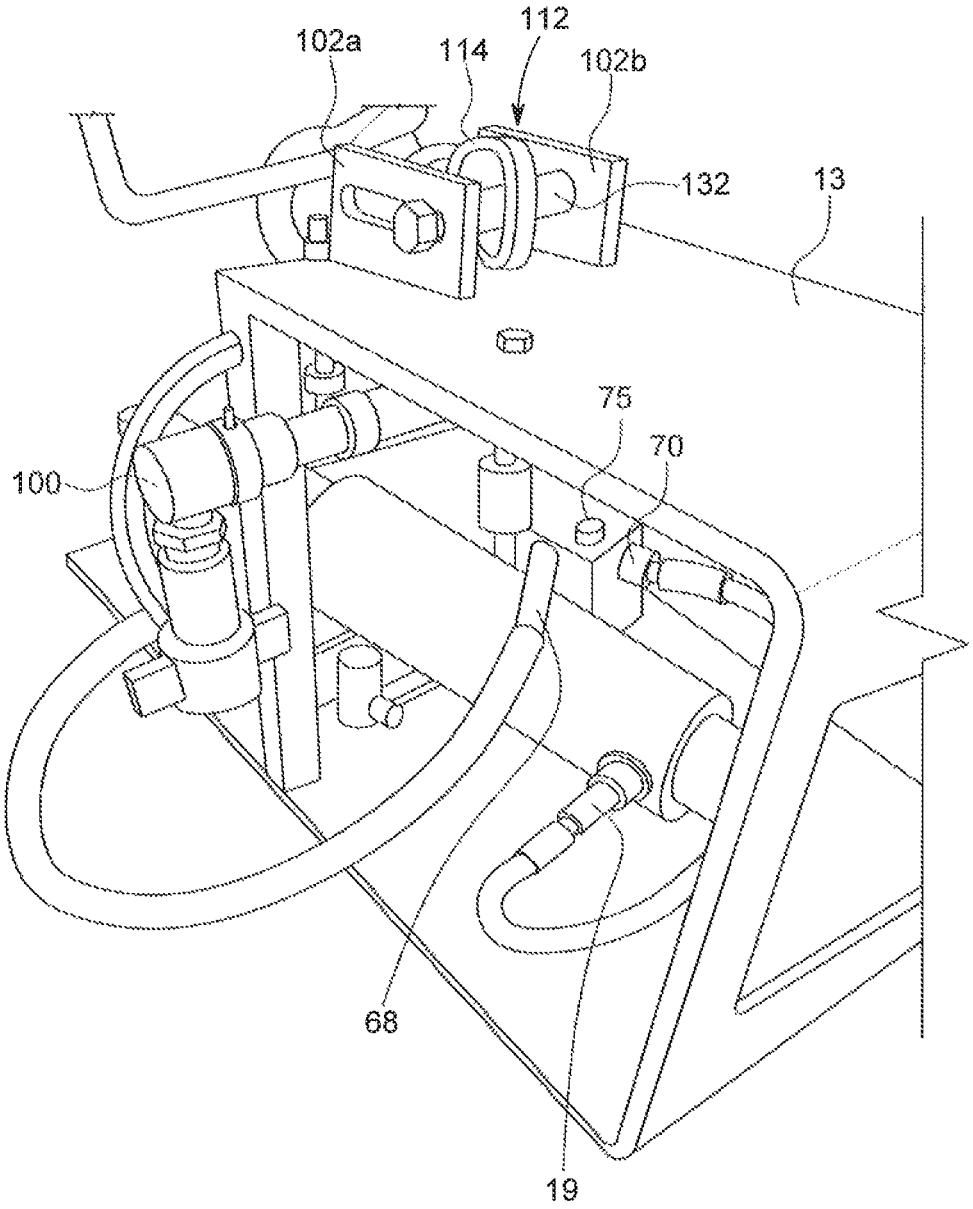

FIG. 9B depicts an input port 100 for receiving hydraulic fluid from a reservoir of a manifold of the hydraulic control assembly.

The integral one piece frame 13 and the hydraulic cylinder can be within the frame showing the second pivoting hydraulic cylinder port 19.

In embodiments, the first bidirectional control port 68 can bidirectionally flow the hydraulic fluid to and from the first pivoting hydraulic cylinder port 18. The second bidirectional control port 70 can bidirectionally flow the hydraulic fluid to and from the second pivoting hydraulic cylinder port.

The flexible hanger and leveling device 112 can have a pair of slotted plates 102*a* and 102*b* mounted in parallel on a top side of the one piece frame 13. A leveling screw 132 can be mounted through the slots of the pair of slotted plates. A shackle 114 can be moveably positioned around the leveling screw.

The leveling screw of the flexible hanger and leveling device 112 can have a helical groove enabling the shackle to slide over the leveling screw. The helical groove can be as wide as the shackle is wide. All elements of the flexible hanger and leveling system can be made from steel.

In embodiments, a cylinder speed valve 75 can be used for controlling the flow of the hydraulic fluid through the pivoting hydraulic cylinder in order to control the speed at which the cylinder rod moves back and forth in the pivoting hydraulic cylinder.

Figure 9C:
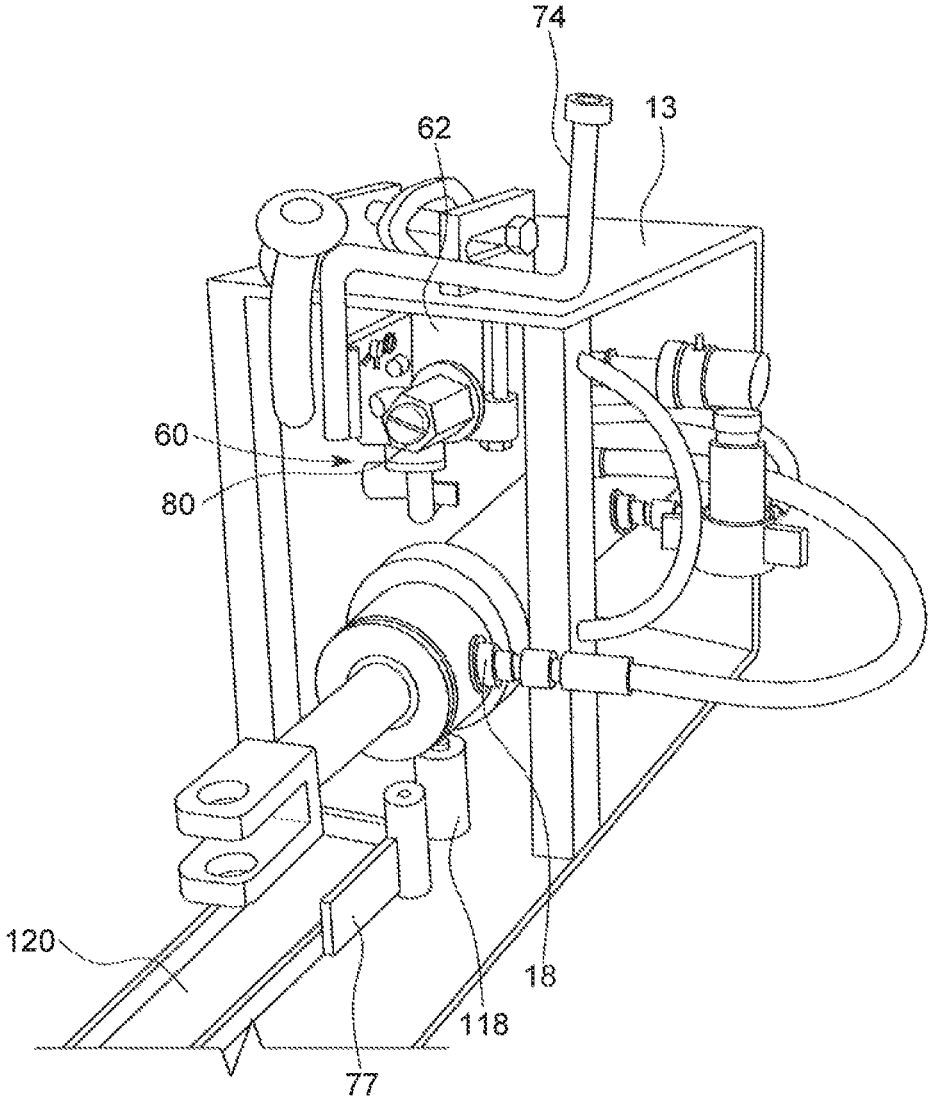

FIG. 9C depicts another view of this embodiment showing the integral one piece frame 13.

A primary pressure control valve 80 shown, which can adjust hydraulic fluid pressure to the pivoting hydraulic cylinder.

A first pivoting hydraulic cylinder port 18 and a second pivoting hydraulic cylinder port 19 of the pivoting hydraulic cylinder 14 are depicted.

Connected within the frame and through the frame is the pivoting hydraulic cylinder mounted over a bearing roller 118 that connects the pivoting hydraulic cylinder to the base.

Also within the integral one piece frame 13 can be a hydraulic control assembly 60.

A lever 74 can engage the manifold 62 for changing hydraulic fluid flow rates to and from the pivoting hydraulic cylinder.

In embodiments, the accelerated rod and sinker bar break out device for rods and sinker bars can have a wrench stop 77 to control pivoting to within a preset limit and a tool tray 120 providing protected containerization of pivoting wrenches on the base.

Figure 9D:
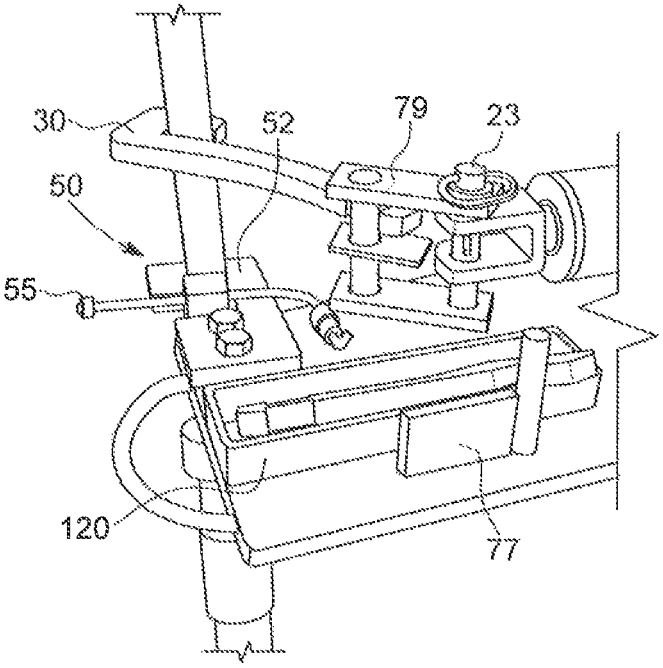
Figure 9E:
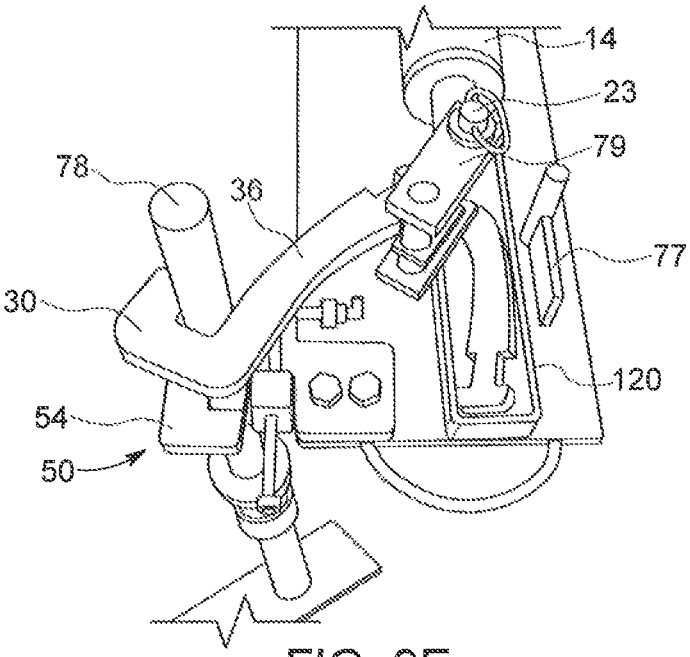

FIGS. 9D and 9E depicts a pivoting wrench 30 that connects to the cylinder rod wherein the cylinder rod clevis engages a rod 78. The pivoting wrench can have wrench flats for a more secure engagement with the rod 78.

A second pin 23 connects the pivoting wrench to the pivoting hydraulic cylinder 14, enabling the wrench flats of the pivoting wrench to be at an angle to the second pin, such as at a 30 degree angle.

The pivoting wrench 30 and the pivoting wrench arm 36 can be connected to the rod 78 via the second pin 23.

Separated from the pivoting wrench and attached to the base is a stationary wrench 50.

The stationary wrench 50 connects to the base such as by rivets, or bolts and nuts. Other fastening systems can be used which can sustain the torque needed to make up or break out the pipe.

In embodiments, a base lock 55 can be shown.

The stationary wrench can have an arm 52 connected to a head 54.

The arm can extend from the base in the same plane as the base and can be oriented so that the head 54 has an opening that opens away from the base.

The head can be configured for engaging a rod 78 extending from a wellbore.

The opening of the head of the stationary wrench can be oriented opposite to the opening of the head 54 of the pivoting wrench 30 to provide full torque to the pipe without twisting the device.

The hydraulic control assembly can have a plurality of components, all mounted within the integral one piece frame.

In embodiments, the accelerated rod and sinker bar break out device can use a pivoting wrench 30 that has an angled wrench head and a pivoting wrench arm. The angled head can be 10 to 40 degrees angled from the longitudinal axis of the wrench arm. The pivoting wrench arm can engage with the pivoting hydraulic cylinder with removable pin or with a latching head 79 or both.

The tool tray 120 can be shown, providing protected containerization of pivoting wrenches on the base.

In embodiments, the wrench stop 77 is depicted.

In this embodiment, the accelerated rod and sinker bar break out device can be elevated enabling rod break out at an elevation from a top of a wellhead to 35 feet above the wellhead by handing from the flexible hanger and leveling device, and wherein the pivoting wrench and the pivoting hydraulic cylinder can simultaneously pivot to engage rods and sinker bars from a wellbore to break out the rods and sinker bars. The pivoting wrench is configured to operate right side up and upside down for optimizing pivoting wrench flat fit.

As shown in other figures this embodiment of the accelerated rod and sinker bar break out device can have an active radio frequency identification chip secured to the base for tracking a GPS location of each accelerated rod and sinker bar break out device when deployed, and wherein the radio frequency identification chip communicates via a network to at least one client device having a client device display and a client device processor communicating with computer instructions in a client device data storage instructing the client device processor to position the GPS location of the accelerated rod and sinker bar break out device geographically on a map and a microprocessor connected to at least one pressure sensor for automatically monitoring and comparing detected pressures to preset limits stored in a microprocessor data storage, and computer instructions for instructing the microprocessor to provide an alarm to the client device processor via the network when the pressure falls below or exceeds the preset limits.

In embodiment of this version of the accelerated rod and sinker bar break out device, the pivoting wrench and the stationary wrench each can have a length from 4 inches to 12 inches.

In embodiments of this version of the accelerated rod and sinker bar break out device the pivoting wrench has a head with a length different than the head of the stationary wrench. In other embodiments, the pivoting wrench arm has a length different than the stationary wrench arm.

This version of the invention contemplates that the accelerated rod and sinker bar break out device uses a stationary wrench with a hook shape to hold the accelerated rod and sinker bar break out device stable as the pivoting wrench head is attached to the wrench flats of rods and sinker bars being broke out.

In embodiments, the accelerated rod and sinker bar break out device for rods and sinker bars can have a latching head 79 connected to the cylinder rod and wherein the pivoting wrench enabling adjustment of the pivoting wrench to a location of the rod or sinker bar.

While these embodiments have been described with emphasis on the embodiments, it should be understood that within the scope of the appended claims, the embodiments might be practiced other than as specifically described herein.

What is claimed is:

1. An accelerated rod and sinker bar break out device for rods and sinker bars extending from a wellbore, the accelerated rod and sinker bar break out device comprising:

a. a base with a base support;

b. a plurality of flexible hanging devices removably connected to the base enabling hoisting of the accelerated rod and sinker bar break out device;

c. a pivoting hydraulic cylinder connected to the base support on a first end, the pivoting hydraulic cylinder having a cylinder rod, a first pivoting hydraulic cylinder port, and a second pivoting hydraulic cylinder port;

d. a first pin connecting the pivoting hydraulic cylinder to the base support;

e. a pivoting wrench connected to the cylinder rod having wrench flats;

f. a second pin connecting the pivoting wrench to the pivoting hydraulic cylinder, wherein the wrench flats of the pivoting wrench are at an angle to the second pin;

g. a stationary wrench connected to the base, the stationary wrench having an arm connected to a head, the arm extending at an angle of 90 degrees to a plane of the base, the head configured for engaging a wrench flat formed on a rod extending from the wellbore; and h. a hydraulic control assembly mounted to the base, the hydraulic control assembly comprising:

(i) a manifold comprising:

1. an input port for receiving hydraulic fluid from a reservoir;
2. an output port for transferring the hydraulic fluid to the reservoir;
3. a first bidirectional control port to bidirectionally flow the hydraulic fluid to and from the first pivoting hydraulic cylinder port; and
4. a second bidirectional control port to bidirectionally flow the hydraulic fluid to and from the second pivoting hydraulic cylinder port;

(ii) a lever engaging a manifold rod in the manifold for changing hydraulic fluid flow rates to and from the pivoting hydraulic cylinder; and (iii) a primary pressure control valve to adjust hydraulic fluid pressure to the pivoting hydraulic cylinder, and wherein the accelerated rod and sinker bar break out device can be elevated enabling rod break out at an elevation from atop a wellhead to 35 feet above the wellhead, and wherein the pivoting wrench and the pivoting hydraulic cylinder can simultaneously pivot to engage wrench flats on rods and sinker bars to break out the rods and sinker bars, the pivoting wrench configured to operate right side up and upside down for optimizing pivoting wrench flat fit.

2. The accelerated rod and sinker bar break out device of claim 1, wherein the pivoting wrench comprises an angled wrench head and a pivoting wrench arm.

3. The accelerated rod and sinker bar break out device of claim 1, comprising an active radio frequency identification chip secured to the base for tracking a GPS location of each accelerated rod and sinker bar break out device when deployed, and wherein the radio frequency identification chip communicates via a network to at least one client device having a client device display and a client device processor communicating with computer instructions in a client device data storage instructing the client device processor to position the GPS location of the accelerated rod and sinker bar break out device geographically on a map.

4. The accelerated rod and sinker bar break out device of claim 3, comprising a microprocessor connected to at least one pressure sensor for automatically monitoring and comparing detected pressures to preset limits stored in a microprocessor data storage, and computer instructions for instructing the microprocessor to provide an alarm to the client device processor via the network when the pressure falls below or exceeds the preset limits.

5. The accelerated rod and sinker bar break out device of claim 1, further comprising a support beam mounted in parallel to the pivoting hydraulic cylinder to prevent collapse of the base.

6. The accelerated rod and sinker bar break out device of claim 1, wherein the hydraulic pressure of the hydraulic fluid in the manifold is from 1000 psi to 3000 psi.

7. The accelerated rod and sinker bar break out device of claim 1, wherein the pivoting wrench and the stationary wrench each have a thickness from ½ of an inch to 1 inch.

8. The accelerated rod and sinker bar break out device of claim 1, wherein the pivoting wrench and the stationary wrench each comprises a hardened high tensile strength solid steel hardened to a Rockwell 55 hardness.

9. The accelerated rod and sinker bar break out device of claim 1, wherein the pivoting wrench and the stationary wrench, each have a length from 4 inches to 12 inches.

10. The accelerated rod and sinker bar break out device of claim 1, wherein the stationary wrench has a hook shape to hold the accelerated rod and sinker bar break out device stable as the pivoting wrench head is attached to the wrench flats of rods and sinker bars being broke out.

11. An accelerated rod and sinker bar break out device for rods and sinker bars extending from a wellbore, the accelerated rod and sinker bar break out device comprising:

a. a base with a base support and an extended side;

b. an integral one piece frame connected to the base;

c. a flexible hanger and leveling device removably connected to the integral one piece frame configured for supporting the accelerated rod and sinker bar break out device while hoisting;

d. a pivoting hydraulic cylinder mounted to the integral one piece frame, the pivoting hydraulic cylinder having a cylinder rod, a cylinder rod clevis mounted to the cylinder rod, a first pivoting hydraulic cylinder port, and a second pivoting hydraulic cylinder port;

e. a bearing roller connecting the pivoting hydraulic cylinder to the base;

f. a pivoting wrench connected to the cylinder rod having wrench flats;

g. a second pin connecting the pivoting wrench to the pivoting hydraulic cylinder, and wherein the wrench flats of the pivoting wrench are at an angle to the second pin;

h. a stationary wrench connected to the base, the stationary wrench having an arm connected to a head, the arm extending from the base in the same plane as the base, the head configured for engaging a rod extending from the wellbore; and i. a hydraulic control assembly mounted within the integral one piece frame, the hydraulic control assembly comprising:

(i) a manifold comprising:

1. an input port for receiving hydraulic fluid from a reservoir;
2. an output port for transferring the hydraulic fluid to the reservoir;
3. a first bidirectional control port to bidirectionally flow the hydraulic fluid to and from the first pivoting hydraulic cylinder port; and
4. a second bidirectional control port to bidirectionally flow the hydraulic fluid to and from the second pivoting hydraulic cylinder port;

(ii) a lever engaging the manifold for changing hydraulic fluid flow rates to and from the pivoting hydraulic cylinder; and (iii) a primary pressure control valve to adjust hydraulic fluid pressure to the pivoting hydraulic cylinder, and wherein the accelerated rod and sinker bar break out device can be elevated enabling rod break out at an elevation from atop a wellhead to 35 feet above the wellhead, and wherein the pivoting wrench and the pivoting hydraulic cylinder can simultaneously pivot to engage rods and sinker bars to break out the rods and sinker bars, the pivoting wrench configured to operate right side up and upside down for optimizing pivoting wrench flat fit.

12. The accelerated rod and sinker bar break out device of claim 11, wherein the a flexible hanger and leveling device comprises:

a pair of slotted plates mounted in parallel on a top side of the one piece frame;

a leveling screw mounted through the slots of the pair of slotted plates; and a shackle moveable positioned around the leveling screw.

13. The accelerated rod and sinker bar break out device of claim 12, wherein the leveling screw of the flexible hanger and leveling device comprises a helical groove enabling the shackle to slide over the leveling screw.

14. The accelerated rod and sinker bar break out device of claim 11, wherein the pivoting wrench comprises an angled wrench head and a pivoting wrench arm.

15. The accelerated rod and sinker bar break out device of claim 11, comprising an active radio frequency identification chip secured to the base for tracking a GPS location of each accelerated rod and sinker bar break out device when deployed, and wherein the radio frequency identification chip communicates via a network to at least one client device having a client device display and a client device processor communicating with computer instructions in a client device data storage instructing the client device processor to position the GPS location of the accelerated rod and sinker bar break out device geographically on a map and a microprocessor connected to at least one pressure sensor for automatically monitoring and comparing detected pressures to preset limits stored in a microprocessor data storage, and computer instructions for instructing the microprocessor to provide an alarm to the client device processor via the network when the pressure falls below or exceeds the preset limits.

16. The accelerated rod and sinker bar break out device of claim 11, wherein the pivoting wrench and the stationary wrench, each have a length from 4 inches to 12 inches.

17. The accelerated rod and sinker bar break out device of claim 11, wherein the stationary wrench has a hook shape to hold the accelerated rod and sinker bar break out device stable as the pivoting wrench head is attached to the wrench flats of rods and sinker bars being broke out.

18. The accelerated rod and sinker bar break out device of claim 11, comprising a wrench stop to control pivoting to within a preset limit and a tool tray providing protected containerization of the pivoting wrench on the base.

19. The accelerated rod and sinker bar break out device of claim 11, comprising a latching head connected to the cylinder rod and the pivoting wrench enabling adjustment of the pivoting wrench to a location of the rod or sinker bar.

* * * * *